United States Patent [19]

Anahara et al.

[11] Patent Number: 4,497,089

[45] Date of Patent: Feb. 5, 1985

[54] FIBER DRAFTING ARRANGEMENT

[75] Inventors: Meiji Anahara, Kariya; Yoshihisa Suzuki, Chiryu, both of Japan

[73] Assignee: Kabushiki Kaisha Toyoda Jidoshokki Seisakusho, Aichi, Japan

[21] Appl. No.: 416,316

[22] Filed: Sep. 9, 1982

[30] Foreign Application Priority Data

Sep. 16, 1981 [JP] Japan ..... 56-136273[U]

[51] Int. Cl.[3] ..... D01H 5/72; D01H 5/86

[52] U.S. Cl. ..... 19/288; 19/246

[58] Field of Search ..... 19/288, 246, 247, 249

[56] References Cited

U.S. PATENT DOCUMENTS 2,840,860 7/1958 Raper ..... 19/288

3,270,397 9/1966 Ingham et al. ..... 19/288

*Primary Examiner*—Louis K. Rimrodt

*Assistant Examiner*—Judith L. Kravitz

*Attorney, Agent, or Firm*—Burgess, Ryan & Wayne

[57] ABSTRACT

A drafting arrangement including a collector means suitably utilized for fasciated yarn spinning. The collector means in the shape of a hollow shell is disposed between a preceding draft means such as a pair of front rollers and the post draft means such as a pair of a aprons, in such a manner that a front surface of the collector means confronts a rearward surface of the preceding draft means and, on the other hand, a rear surface of the collector means confronts a front surface of the post draft means with a predetermined clearance. By this construction, a concomitant air stream accompanying rotation of the draft means is effectively expelled out of the fiber passage and stable drafting can be accomplished.

4 Claims, 5 Drawing Figures

FIBER DRAFTING ARRANGEMENT

BACKGROUND OF THE INVENTION

1. Field of the Invention

Figure 1:
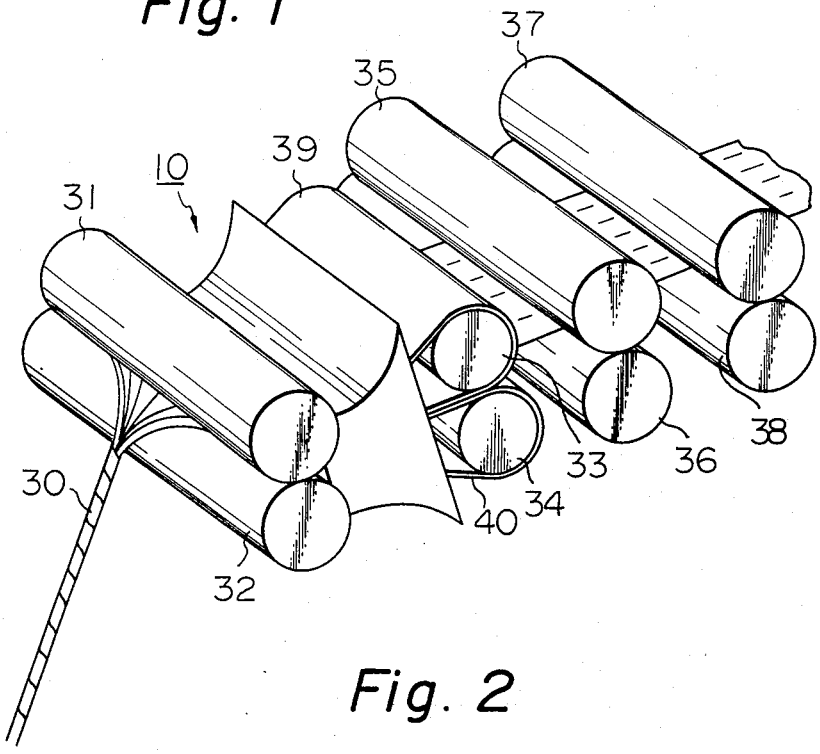

This invention relates to a means for drafting a fiber bundle such as a sliver or a roving. More specifically it relates to a means for drafting a fiber bundle, which is suitable for a high speed spinning machine such as a fasciated yarn spinning frame.

2. Description of the Prior Art

In the spinning process, a so-called roller drafting arrangement by which a fiber bundle is attenuated with a plurality of pairs of draft rollers rotating at sequentially higher peripheral speeds one after the other, has widely been utilized.

In the above-mentioned conventional drafting means, a concomitant air stream often occurs in the vicinity of the surface of the rotating roller. The speed of the air stream accelerates as the rotational speed of the roller increases, but if the speed of the roller exceeds 60 meters/min, the air stream disturbs the ribbon of the fiber bundle traveling through the draft zone between the two pairs of rollers. This causes a deterioration in the quality of the resulting yarn, especially in the case of a thin fiber bundle, as well as an increase in flies. These drawbacks are pronounced in the vicinity of front rollers rotating at the highest speed among the draft rollers.

Also, in the conventional drafting arrangement, various types of collectors are utilized between draft rollers for controlling the width of the ribbon of the fiber bundle, which tends to spread excessively due to a nipping pressure of the draft rollers; and a wider width of the fiber ribbon causes a separation in the edge portion fibers which may often wrap around the roller or form flies. Especially, in the fasciated yarn spinning process, the collector means is very important since the edge portion fibers have to twine around a core portion of the fiber bundle to form a tightly fasciated yarn.

However, since the conventional collector means is, in general, designed to function effectively at a speed less than 60 meters/min., it is not protected from the concomitant air stream around the circumference of the roller. For example, the conventional collector means is of a U-shape with an open top side and is short in length along the traveling direction of the fiber bundle. This form is not suitable for protecting the fiber bundle from the concomitant air stream. Especially in case of fasciated yarn spinning, when the operational speed exceeds 150 meters/min. poor results are obtained if the conventional collector means is utilized.

SUMMARY OF THE INVENTION

An object of the present invention is to provide a drafting arrangement which can protect a fiber bundle traveling through a draft zone from a concomitant air stream accompanied with high speed rotation of draft rollers.

Another object of the present invention is to provide an improved collector means for guiding a fiber bundle with minimal disturbance of the concomitant air stream.

BRIEF DESCRIPTION OF THE INVENTION

The present invention is more specifically described referring to the accompanying drawings.

Figure 2:
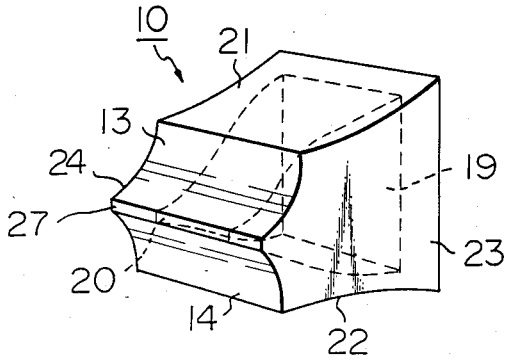
Figure 3:
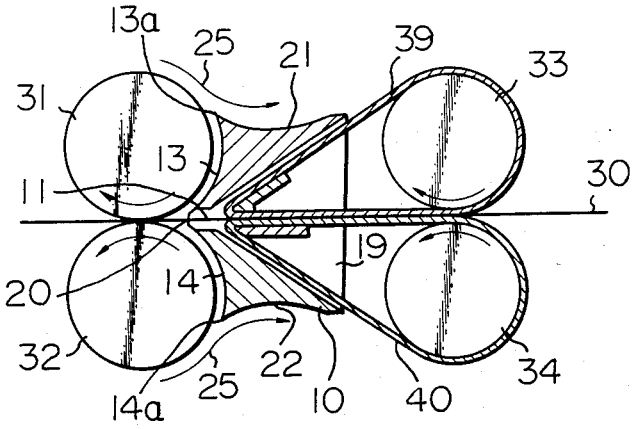
Figure 4:
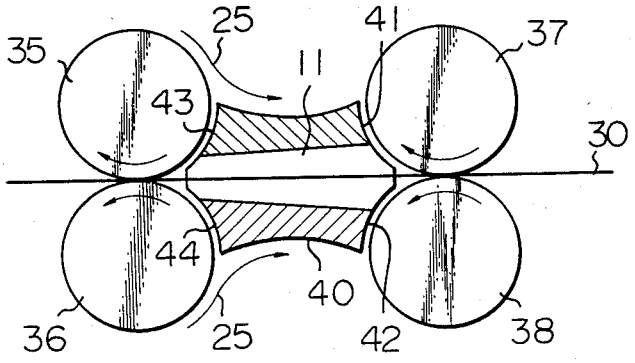
Figure 5:
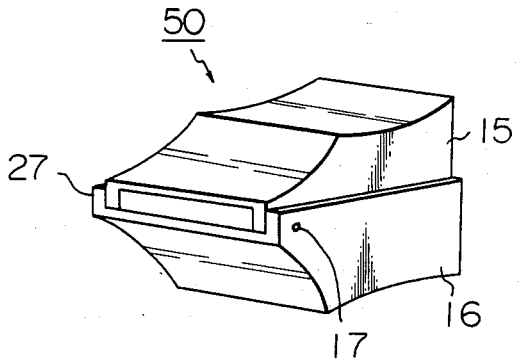

In the drawings;

FIG. 1 is a perspective view of an embodiment of a drafting arrangement according to the present invention, FIG. 2 is a perspective view of a collector means incorporated in the embodiment shown in FIG. 1, FIG. 3 is a partially enlarged side view showing an elevational section of the embodiment shown in FIG. 1, FIG. 4 is a side view showing an elevational section of another embodiment of the drafting arrangement according to the present invention, and FIG. 5 is a perspective view of an improvement of the collector means shown in FIG. 2.

DETAILED EXPLANATION OF THE PREFERRED EMBODIMENT

In FIG. 1, an embodiment of a drafting arrangement according to the present invention comprised the pairs of back rollers 37, 38; third rollers 35, 36; second rollers 33, 34 wound therearound aprons 39, 40, respectively; and front rollers 31, 32. Between the pair of aprons 39, 40 and the pair of front rollers 31, 32 is positioned a collector means 10.

A fiber bundle 30, introduced into the drafting arrangement from the right hand of FIG. 1, is sequentially attenuated between the draft zones formed by the pairs of the above-mentioned rollers or aprons and is finally delivered from the front rollers 31, 32.

The collector means 10 incorporated in the embodiment is a pyramid-shaped funnel with top and bottom walls 21, 22 and left and right side walls 23, 24. The walls 21, 22, 23, and 24 form a hollow shell with an inlet 19 having a large rectangular opening and an outlet 20 having a flat slit-like opening. By means of the outlet 20, the width of the fiber ribbon is confined.

The top wall 21 has a front portion 13, which has a concave surface complemental to the lower half of the rear side of the front top roller 31, and similarly, the bottom wall 22 has a front portion 14 which has a concave surface complemental to the upper half of the rear side of the front bottom roller 32. As a result, at the front end of the collector means 10 is formed a flat nose portion 27 provided with the outlet 20 at the center thereof.

On the other hand, rear portion of the top and the bottom wall 21 and 22 extend to cover the front part of exposed surfaces of the aprons 39 and 40, and the inner sides of the top and the bottom walls are converged toward the outlet 20. The rear portion of the side walls 23 and 24 also extends to cover the side opening of the aprons 39 and 40.

The collector means 10 is disposed so that the outlet 20 just confronts the nip line of the front rollers 31 and 32. In this position, the front portions 13 and 14 of the walls 21 and 22 also closely confront the rear side surfaces of the front rollers 31 and 32, and the inner sides of the rear portions of the collector means 10 closely cover the part of the exposed surfaces of the aprons 39 and 40 with a predetermined clearance.

According to the collector means 10, since the front portions 13 and 14 of the top and bottom walls 21 and 22 are positioned closely to the surfaces of the front rollers 31 and 32, the concomitant air stream due to the rotation of the front rollers is prevented from flowing around the surfaces of the rollers by means of edges 13*a* and 14*a* of the front portion 13 and 14, and its flowing direction is changed to a path relating to rear portions of the aprons 39 and 40 along the outer surfaces of the top and bottom walls 21 and 22, as shown with arrows 25 in FIG. 3.

Thus, the fiber bundle 30 traveling through a fiber passage 11 between the front end of the aprons 39, 40 and a nip line formed by the front rollers 31, 32 is free from any disturbance caused by the concomitant air stream due to the rotation of the front rollers 31 and 32.

Further, since the side walls 23 and 24 envelop the open sides of the aprons 39 and 40, air which may invade the draft zone accompanied by the traveling aprons 39 and 40 and may cause the aforesaid drawbacks is effectively shut off.

The drafting arrangement shown in FIGS. 1 to 3 is preferably utilized for high speed spinning such as fasciated yarn spinning, operating at a delivery speed of more than 60 m/min. In case the speed is less than 60 m/min., a shorter length of the rear portion of the collector means, corresponding only to the nose end of the aprons, may be enough to protect the fiber bundle from any disturbance of the concomitant air stream caused by the aprons.

FIG. 4 shows another embodiment of the drafting arrangement according to the present invention. This embodiment is provided with a collector means 40 between two pairs of draft rollers such as the third rollers 35, 36 and back rollers 37, 38 in FIG. 1.

The collector means 40 is of a tubular shape, the front portion thereof having concave end surfaces 43, 44 complemental to the surfaces of the third rollers 35 and 36, and, the rear portion thereof also having concave end surfaces 41, 42 complemental to the surfaces of the back rollers 37 and 38. The collector means 40 is disposed to confront the concave front end with the rear side surface of the third rollers 35 and 36 and to confront the concave rear end with the front side surfaces of the back rollers 37 and 38 with a predetermined clearance. Accordingly, since a concomitant air stream around the third rollers 35 and 36 is forced to shift its direction toward the rear along the outer surface of the collector 40, as shown with arrows 25 in FIG. 4, the bundle is protected from the concomitant air stream. Further, since the fiber bundle is effectively guarded thoughout the fiber passage with the shell of the collector means 40, invading air into the draft zone is completely shut off and stable drafting can be expected.

FIG. 5 illustrates an improvement of the collector means shown FIGS. 1 to 3. A collector means 50 consists of at least two members 15 and 16. The members 15 and 16 are of the shapes just dividing the collector means 10 of FIG. 2 along the fiber passage, and are pivotally integrated together with pins 17 at the side walls of the nose portion 27. Thus, the tail end of the upper member 15 can be lifted up around the pin 7, and the top apron exposed. Due to this construction, when the top apron has been damaged, it can readily be exchanged with a new one provided the top roller 31 is removed.

In the above-mentioned embodiments, the inlet 19 is of approximately a square shape. However, it may be of any other shape.

The surface of the collector means confronting the rollers or the aprons is preferably aventurine or mirror plane causing friction to the fiber to be small.

According to the present invention, the fiber bundle traveling through a draft zone in the form of a ribbon, can be effectively protected from the concomitant air stream accompanying the rotation of the draft rollers or aprons. So any disturbance of the orientation of the fibers in the ribbon is avoided. Especially, application to a fasciated yarn spinning process is very advantageous, because the fiber ribbon can be controlled with the collector means in order to have a suitable width without any separation in the edge portion fibers, and as a result, a tightly fasciated yarn can be spun.

We claim:

1. A fiber drafting arrangement comprising:

a pair of top and bottom rollers for drawing fibers between said rollers;

a pair of top and bottom aprons disposed upstream of said rollers for guiding fibers along a path toward said rollers; and collector means disposed between said rollers and said aprons, said collector means having top and bottom walls and side walls with a hollow funnel-like space within said walls, said funnel-like space receiving adjacent portions of said aprons with a predetermined clearance, external wall surfaces of said collector means confronting adjacent surface portions of said rollers with a predetermined clearance, so that fibers traversing said aprons and rollers are subjected to minimal air disturbance.

2. A fiber drafting arrangement according to claim 1, wherein said collector means have a front surface of a concave shape complemental to said surface portions of said rollers.

3. A fiber drafting arrangement according to claim 1, wherein said aprons have side openings and said side walls of said collector means cover a portion of the side openings of said aprons adjacent said rollers.

4. A fiber drafting arrangement according to claim 1, wherein said collector means comprises two pivotably members connected together with pins adjacent said path, so that one of said members can be moved away from the other member to expose an adjacent portion of said path.

* * * * *